US010085098B2

(12) United States Patent
Martinez Azkorra

(10) Patent No.: US 10,085,098 B2
(45) Date of Patent: Sep. 25, 2018

(54) FINE TUNING SYSTEM AND METHOD

(71) Applicant: Luis Ignacio Martinez Azkorra, Wilen (CH)

(72) Inventor: Luis Ignacio Martinez Azkorra, Wilen (CH)

( * ) Notice: Subject to any disclaimer, the term of this patent is extended or adjusted under 35 U.S.C. 154(b) by 22 days.

(21) Appl. No.: 14/109,409

(22) Filed: Dec. 17, 2013

(65) Prior Publication Data

US 2015/0172837 A1 Jun. 18, 2015

(51) Int. Cl.
*H04R 25/00* (2006.01)

(52) U.S. Cl.
CPC ..... *H04R 25/70* (2013.01)

(58) Field of Classification Search
CPC ..... H04R 25/70; A61B 5/121; A61B 5/12; G06F 19/322
See application file for complete search history.

(56) References Cited

U.S. PATENT DOCUMENTS 6,574,340 B1 * 6/2003 Bindner et al. ..... 381/60
8,767,986 B1 * 7/2014 Fabry et al. ..... 381/314
9,173,043 B2 * 10/2015 Bulow ..... H04R 25/70
2002/0194022 A1 * 12/2002 Comite ..... G06F 19/322 705/2
2003/0194095 A1 * 10/2003 Chalupper ..... H04R 25/70 381/60
2004/0264719 A1 * 12/2004 Naylor ..... H04R 25/70 381/314
2008/0125672 A1 * 5/2008 Burrows ..... A61B 5/121 600/559
2008/0187145 A1 * 8/2008 Burrows ..... A61B 5/0002 381/60
2008/0212789 A1 * 9/2008 Cronin ..... H04R 25/70 381/60
2011/0235835 A1 * 9/2011 Bulow ..... H04R 25/70 381/314
2011/0313315 A1 * 12/2011 Attias ..... A61B 5/12 600/559
2012/0051569 A1 * 3/2012 Blamey et al. ..... 381/314
2013/0054318 A1 * 2/2013 Jarng ..... 705/14.4
(Continued)

FOREIGN PATENT DOCUMENTS

WO WO 2004041136 A1 * 5/2004 ..... A61N 1/36032

OTHER PUBLICATIONS

Kochkin, "MarkeTrak VIII: Consumer satisfaction with hearing aids is slowly increasing", *The Hearing Journal*, Jan. 2010, pp. 19-27.

*Primary Examiner* — Fan Tsang
*Assistant Examiner* — Angelica M McKinney
(74) *Attorney, Agent, or Firm* — Oliff PLC

(57) ABSTRACT

The present invention relates to a system for optimizing the fine tuning of a generally known adaptation process, in particular a hearing aid fitting process, on the basis of the individual needs of a customer, the system comprising: a platform on which at least a customer data base and a training scheme for the customer are provided, a web tool by means of which the customer can interact with the platform, in particular input his data into the customer database, a professional unit which sets up the training scheme for the customer and which monitors the data input by the customer, the professional unit being equipped with means for establishing a personal contact with the customer, as well as to a respective process.

29 Claims, 6 Drawing Sheets

(56) References Cited

U.S. PATENT DOCUMENTS

2013/0177188 A1* 7/2013 Apfel ..... H04R 25/558
381/315
2015/0023512 A1* 1/2015 Shennib ..... 381/60

* cited by examiner

Fig. 1

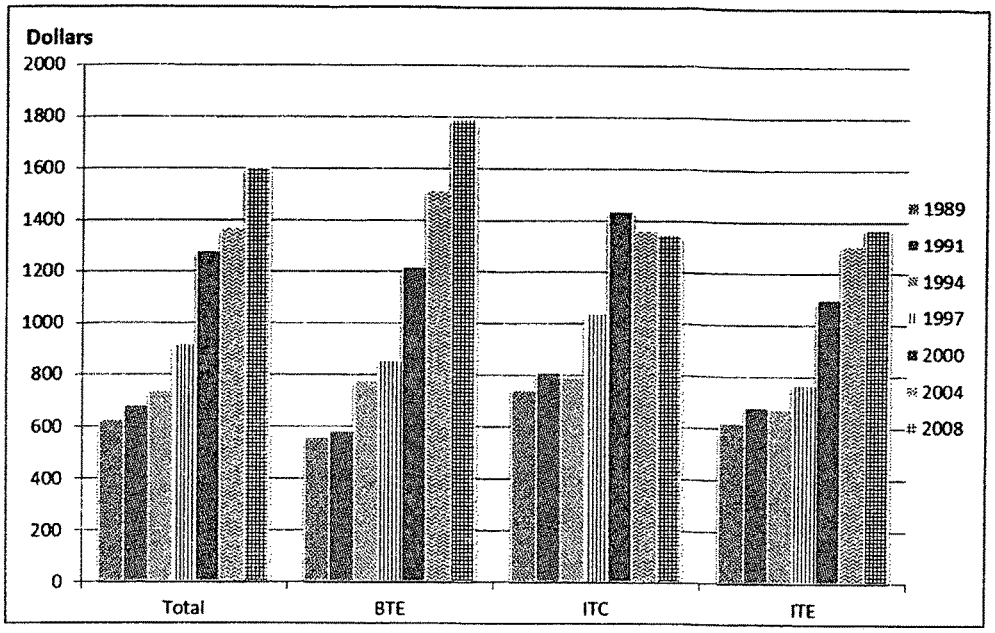

Fig. 2

| | 1984 | 1989 | 1991 | 1994 | 1997 | 2000 | 2004 | 2008 |
|---|---|---|---|---|---|---|---|---|
| Satisfaction with hearing aids | | (n=1,632) | (n=2,323) | (n=2,327) | (n=2,720) | (n=2,572) | (n=2,189) | (n=2,953) |
| Total owner population | | | | | | | | |
| % Satisfied | | 59.6% | 58.2% | 53.5% | 53.9% | 54.7% | 67.9% | 74.0% |
| % Neutral | | 21.7% | 21.7% | 26.6% | 26.4% | 24.3% | 10.8% | 8.6% |
| % Dissatisfied | | 18.7% | 20.1% | 19.9% | 19.8% | 21.0% | 21.3% | 17.3% |
| % hearing aids in drawer (not used) | 13.5% | | 12.0% | 17.9% | 16.2% | 11.7% | 16.7% | 12.4% |
| New hearing aids (</= 1 year) | | | | | | | | |
| % Satisfied | | | 66.4% | 71.8% | 62.9% | 63.1% | 77.5% | 80.6% |
| % Neutral | | | 21.8% | 22.0% | 27.0% | 22.4% | 8.0% | 7.3% |
| % Dissatisfied | | | 11.8% | 6.2% | 10.1% | 14.5% | 14.5% | 12.0% |
| % hearing aids in drawer (not used) | | | 3.0% | 3.5% | 4.6% | 3.1% | 3.8% | 5.2% |
| New hearing aids (</= 4 years) | | | | | | | | |
| % Satisfied | | | 61.0% | 58.7% | 58.9% | 59.4% | 73.1% | 78.6% |
| % Neutral | | | 21.5% | 25.0% | 26.1% | 23.4% | 8.4% | 7.2% |
| % Dissatisfied | | | 17.5% | 16.3% | 15.0% | 17.2% | 18.4% | 14.2% |
| % hearing aids in drawer (not used) | | | 7.7% | 11.1% | 8.8% | 6.8% | 10.0% | 7.5% |

** as of CY 2004 satisfaction changed from a 5 point to 7 point scale with addition of "somewhat satisfied" and "somewhat dissatisfied"*

| | 1991 | 1994 | 1997 | 2000 | 2004 | 2008 |
|---|---|---|---|---|---|---|
| Somehow satisfied | | | | | 23 | 23 |
| Satisfied | 40 | 40 | 39 | 39 | 30 | 31 |
| Very Satisfied | 21 | 19 | 21 | 21 | 21 | 24 |

| | 1991 | 1994 | 1997 | 2000 | 2004 | 2008 |
|---|---|---|---|---|---|---|
| Total dissatisfied | 18 | 16 | 15 | 17 | 18 | 14 |
| HA in the drawer | 8 | 10 | 9 | 7 | 10 | 8 |

| | Benefit | Would recommend hearing aids | Overall Satisfaction | Value | Would repurchase brand of hearing aids |
|---|---|---|---|---|---|
| Satisfied | 86 | 82 | 79 | 66 | 48 |
| Neutral | 6 | 5 | 7 | 18 | 40 |
| Dissatisfied | 8 | 13 | 14 | 16 | 12 |

**Note: In the 2004 MarkeTrak "hearing aid store" was changed to "hearing aid specialist office". Retail store is discount/wholesale club, department store, and drugstore.*

Fig. 9

| | Shop | Session 1 | Session 2 | Session 3 | Session 4 | Session 5 | Session 6 |
|---|---|---|---|---|---|---|---|
| | | 5° day | 12° day | 22° day | 32° day | 42° day | 52° day |
| Pain/Confort | 5 | 4 | 1 | 0 | 0 | 0 | 0 |
| Volume | 5 | 4 | 4 | 3 | 3 | 2 | 1 |
| High/Low | 4 | 4 | 4 | 3 | 3 | 2 | 1 |
| Noise | 5 | 5 | 4 | 3 | 3 | 2 | 1 |
| Feedback | 5 | 5 | 2 | 1 | 0 | 0 | 1 |
| Understanding | 3 | 3 | 4 | 5 | 4 | 3 | 1 |
| Telephone | 5 | 5 | 3 | 2 | 1 | 0 | 1 |
| Wind | 0 | 0 | 4 | 3 | 2 | 1 | 1 |

| Escale: | |
|---|---|
| | 5- Highest |
| | 4- High |
| | 3- Normal |
| | 2- Low |
| | 1- Name it |
| | 0- No |

FINE TUNING SYSTEM AND METHOD

BACKGROUND

The disclosure relates to a fine tuning system and method which are in particular used in connection with after-sales support for the purchaser of medical devices such as hearing aids. The fine tuning system and method may however also be used in connection with other medical consultations which empirically run through the same standard stages, as for example pregnancy counselling or the counselling during certain stages of cancer treatment, which do not necessarily require the personal visit to the doctor each time. It is also conceivable that the proposed fine tuning system and process may also be applied in the economical field in cases where certain routine steps are likely to occur, e.g. in connection with real estate purchase.

However, for the purpose of comprehensive explanation it is referred in the following to the field of use of hearing aids.

Firstly, with regard to the nature of the hearing loss, it is noted that a hearing loss correction with hearing aids is the only sensorial correction performed today on a routine basis.

Typically, any human being over thirty years of age has a somewhat reduced hearing performance. The hearing performance diminishes gradually as part of the aging process and usually reaches at an age of around sixty to seventy years a level where the ability to understand others is significantly impaired, especially in noisy environments.

On the average, the cochlea—i.e. the auditory portion of the inner ear—has more than 23.000 hair cells that die off and never grow again as part of the natural aging process and modern life environment (hair cells are very sensible to loud noises).

It is commonly known that for people who have already lost significant amounts of their hair cells, the only available solution is the use of hearing aids. However, this may not resolve the origin of the problem, namely that the hair cells do not grow again. Rather, the hearing aid may only compensate for some of the effects, i.e. the hearing loss.

The human hearing system operates according to the principle of comparing and matching the sound heard with the sound impressions stored in the brain. Thus, the human hearing system may be regarded as a kind of "brain dictionary" which is acquired as part of the normal learning process. Therein, matching results on words and concepts are (correctly) understood. Yet, sometimes, when the wrong association is established, the (non-matching) words and concepts are misunderstood.

Since the human brain is highly adaptable, it constantly updates the stored sound impressions in order to broaden its capabilities and in order to be able to adapt to new respectively changing sound impressions.

Once the individual starts losing his hearing abilities, his brain quickly adapts the "brain dictionary" in order to maintain the understanding performance. However, since the degradation of the hearing abilities is progressive, the individual will reach at some point a poor level of understanding, even with this adaptation. This is the moment, where the individual will start looking for help, i.e. usually in form of a hearing aid, being one of the few possibilities.

It is worth mentioning that it usually takes an individual approximately twelve years from the moment he recognizes that he has a hearing problem up to the time he actually buys a hearing aid. Since during these years the brain has been working actively to create a new "brain dictionary" (i.e. in order to compensate for the hearing problems), it takes several months for the brain to generate the code for the new hearing impression once a proper hearing is re-established (i.e. with the help of the hearing aid).

This process can be very frustrating for the new user of the hearing aid because on the one hand he will hear much more than before, but on the other hand he may understand much less—despite his new and relatively expensive device.

Constant use of the device and perseverance are the key factors in this part of the process where it is highly important to assist the brain in creating the new code and thus achieving the expected level of understanding.

Thus, in the following, today's hearing aid fitting process is briefly described and divided up into its five basic working steps:

(1) Lead generation: this step includes all the tasks planned and executed that have as main objective to raise interest of potential buyers and induce them to contact a point of sales/an organization in order to gather more information.

(2) Lead conversion: this step includes all the tasks planned and executed that have as main objective to convert the interest of the potential buyer into an actual transaction.

(3) Fitting: this step includes all the tasks regarding diagnostics, evaluation, solution selection and initial activation of such solution adapted to the individual needs of the person with the hearing disability.

(4) Fine tuning: this step includes all the tasks performed after the fitting step to further adapt the use and performance of the solution to the objective and subjective needs of the user.

(5) After sales service: this step includes all the tasks executed to maintain the intended performance of the device once in daily use.

In the technical field, there is a desire to optimize the way of performing in particular the fine tuning and also the after-sales steps of the hearing aid fitting process.

Typically, a full fitting process (including lead conversion, fitting and fine tuning) can take up to fifteen hours. In many cases, the end user comes back up to six times after fitting until either he is satisfied, gives up or returns the instrument for credit.

Return for Credit (RfC) can be as high as 14% of total sales. Typically, the RfC costs an average store up to 1500 USD per ear (in direct cost), not considering recurrent revenues for the same customer which will be lost as well. It is noted in this context that on the average, customers return up to 2.5 times for repurchase during their lifetime.

It has to be considered that the effort of calling the store for an appointment, going to the store, waiting for the appointment, the appointment itself, the costs (in time and emotions) of those six visits after fitting etc., is significant, both for the practice and for the end consumer and generates a significant amount of frustration on both sides. It is worth mentioning that the after-fitting visits of the patient are free of charge and thus represent a direct cost for the store.

In the following, the challenges in today's fitting process are described in more detail.

Typically, after a normal first fitting session, the hearing aid instrument is already programmed for the particular need of the end user. Before leaving, the end user is instructed on several procedures e.g. how to clean his instrument, change the battery, put the instrument into the ear etc. The end user also gets a general guidance on what he can expect from his new instrument and how to deal with the different daily sound environments.

Very often the end user gets various leaflets with general counseling on how to tackle his first experiences with the new hearing aid instrument.

However, it has to be considered that on the one hand this is a lot of new information for a person (often) over seventy years of age and that on the other hand this person is getting most of the counseling in verbal form trough a new instrument that he is not yet used to.

Since initially the results achieved with the new instrument are rather poor, most audiologists ask the end users to come back after a few days to go again through the instructions and to motivate the end user to keep using his new hearing aid. Very often however, the end user is somehow disappointed once he experiences that the understanding is not perfect right away (i.e. there is a gap between expectations and reality).

It is noted that it is rather seldom that the audiologist needs to do some reprogramming changes on the instruments, since it has been found that it is not beneficial to change too much of the initial sound impression in order to keep the learning process as simple as possible. As mentioned before, on the average, an end user comes back up to six times into the store in these first three months, and up to 14% of the end users claim their money back (i.e. the gap between expectations and reality could not be closed).

According to today's practice, there is altogether very little ownership of the adaption process on the side of the end user since it is typically believed that he has bought a device which has to perform by itself.

SUMMARY

The proposed system and method are a redesign and an optimization of the known process and are based on the same lead generation, lead conversion and fitting steps. The innovation occurs predominantly in the fine-tuning and after-sales working steps that require approximately 50% of the time employed for the treatment of each patient.

The proposed system and method thus become effective after the conventional fitting step.

When the new instrument of the end user has been fitted for the first time, the end user's data is entered into an internet based resource center (i.e. database, web).

One of the key elements of the resource center will be an educational process, customized for every end user and monitored by an audiologist.

An audiologist in the context of the present application is a person who takes care of the hearing aid fitting in accordance with the applicable laws and regulations.

It will be appreciated that the resource center respectively the educational process are also applicable for other medical consultations which empirically run through predictable standard stages, as for example pregnancy counselling or the counselling during certain stages of cancer treatment—which do not necessarily require a personal visit to the doctor each time. It is also conceivable that the principles of the resource center respectively the educational process may also be applied in the economical field whenever certain routine steps are likely to occur, e.g. in connection with real estate purchase.

However, staying with the hearing aid application, the end user will be told in advance that:

- the adaptation process will take up to three months,
- he will be fully supported and assisted through that process, and that
- he will only have to come to the store in exceptional cases.

The audiologist will then set-up a customized web content that the end user will be able to follow in a comfortable manner from home through a browser or an app.

A web content in the context of the present application is a content which is stored in or managed from a central server/servers and which is delivered through a browser or an app to the user.

To simplify the delivery of the content, the different instructions will preferably be delivered in timely lessons.

After each lesson, the audiologist, who will be able to track the progress of the users from his practice/store (e.g. on a cockpit screen), will contact the end users individually by telephone, email or chat in order to provide encouragement and to address relevant problems/issues which have arisen in the meantime.

After each lesson and depending on the progress, the audiologist will be able to adapt the content for the subsequent lesson(s), whereby a unique journey for each customer is created. If an adjustment of the instrument is needed, the new system/method will be extremely helpful to identify the specific issues/problems prior to a possible visit.

Prior to each lesson it is advisable to run questionnaires in order to collect end user information on their satisfaction level (e.g. the satisfaction with the fitting process) such that unique insight on people, products and processes may be gathered.

In case an after-sales service is needed, the end user can use the same web tool to help identifying the issue, in some cases fix it and in others to prepare the part replacement in the office/practice before his visit.

The role of the audiologist in the proposed system/method is as follows: after a normal fitting, the audiologist instructs the end user on the operation of his new instrument, gives him some generic instructions and explains to him briefly the aim and functioning of the proposed system/method. Subsequently, the audiologist sets up the content of the tool in accordance with the characteristics of the hearing loss, the end user characteristics and the hearing aid used, provides the end user with a customized login access and trains the end user on the use of the tool. Finally, the audiologist informs the end user that after every interaction with the tool, he will see what the end user has done and will contact him to review the results and, if necessary, arrange an appointment.

The role of the end user in the proposed system/method is as follows: once at home and while using his new instrument, the end user accesses the custom made web content. Initially, he answers several questions about his general perception of his hearing capabilities, the use of his instrument and, if applicable, general questions about how he was treated by the audiologist. Subsequently, the end user gets access to an interactive training area where he is guided through different issues set-up by the audiologist, which may also depend on his previous answers. Once finished, the end user is told that he will be contacted by an audiologist and that the results of his interaction are either sent to or stored for the audiologist. The end user may enter his preferred time frame for e.g. a telephone call with the audiologist.

The interaction between the audiologist and the end user is as follows: on his request (or automatically), the audiologist has access to a cockpit screen where he can supervise the end users during the adaptation period, i.e. monitor the status of their training and the data logging of their training sessions together with the feedback provided. The audiologist is then reminded that he has to contact the respective end users wherein also the relevant topics are indicated to the audiologist (i.e. which result from the individual training sessions).

After the conversation with the end user, the audiologist can input the results of the conversation into the training tool for further use and he can change/adapt the topics for the end user's next training session.

The above described interaction between the end user and the audiologist shall include a period of approximately 40 to 80, preferably 60 days. Further, the end user is periodically reminded that he is due to attend to a session.

The proposed system and method provide for a fine tuning process which is supported by software and has the following objectives:

- increase customer satisfaction (i.e. closing step by step the gap between expectations and reality),
- reduce number of customer shop visits for fine-tuning (maximum 2 after fitting),
- reduce costs and returns for credit (reduce return for credit below 10%),
- unique support during the acclimatization process.

The proposed system/method are intended to redesign and optimize the way that fine-tuning and after-sales are performed today. This two tasks account for 50% of the time and 75% of the visits employed in a hearing aid fitting.

Yet, the present invention also encompasses two concepts for an improved pre-fine tuning process which are described in the following tables:

Basic Concept (Pre-Fine Tuning) Including Audiologist

| End user | Audiologist/Call Center | Observation |
|---|---|---|
| | Professional lead generation organization does marketing and manages calls form users | Can be done in own name or on behalf of big banner or small retailer |
| End user gets interested and asks about price, possibilities, process etc. | Call center answers questions and tries to sell the optimal solution | |
| End user agrees to buy | Call center does the transaction and instructs the end user where to go to get his instruments | |
| End user goes to store | Audiologist does tests and fits the instruments<br>Audiologist reports to call center | |
| End user gets call form call center | Call center calls the end user and asks about his perceptions and introduces him to the fine tuning training web site, if applicable | |

Advanced Concept (Pre-Fine Tuning) without Audiologist

| End user | Audiologist/Call Center | Observation |
|---|---|---|
| | Professional lead generation organization does marketing and manages calls form users | Can be done in own name or on behalf of big banner or small retailer |

-continued

| End user | Audiologist/Call Center | Observation |
|---|---|---|
| End user gets interested and asks about price, possibilities, process etc. | Call center answers questions and tries to sell the optimal solution | |
| End user agrees to buy | Call center does the transaction and instructs the end user where to go to get his instruments<br>Call center does test via telephone/ internet and ships pre-programmed instruments | |
| End user receives instruments | Call center fine tunes/fits instruments remotely with the aid of the inventive system/method | |

BRIEF DESCRIPTION OF THE DRAWINGS

The invention is explained in more detail below with reference to the drawings, in which, purely schematically:

FIG. 1 shows a chart illustrating the price development for hearing aids of different styles;

FIG. 2 shows a chart illustrating the general consumer satisfaction with hearing aids;

FIG. 9 shows a customized chart for a hearing aid fine tuning in accordance with the present invention.

From FIG. 1, one can derive that in the past view years, the prices for hearing aids have generally increased significantly. This is in particular true for BTE ("behind the ear") and ITE ("in the ear") devices whereas prices for ITC ("in the canal") devices have slightly decreased.

FIGS. 2-5 demonstrate that there has been a slight improvement in consumer satisfaction on the whole, wherein however the total number of consumers who are "satisfied" or "very satisfied" (cf. FIG. 3) has not improved. In particular FIG. 3 thus offers evidence that the total dissatisfaction is rather improving. For more detailed interpretation of the above data, it is referred to the specialist article of Sergei Kochkin "MarkeTrak VIII: Consumer satisfaction with hearing aids is slowly increasing" in THE HEARING JOURNAL, VOL. 63, No. 1, pages 19-27.

Figure 3:
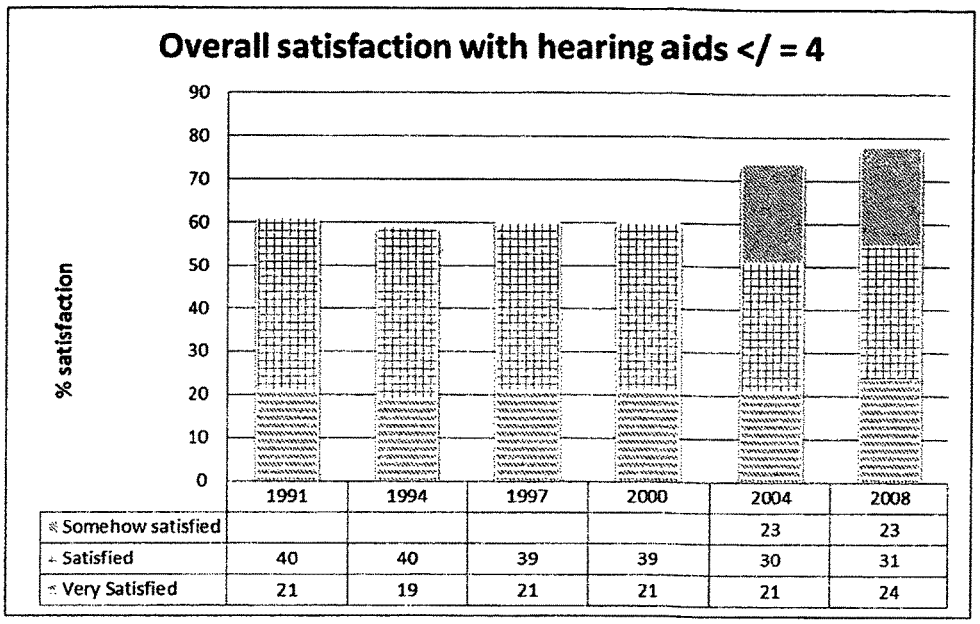
FIG. 3 shows a chart illustrating the overall satisfaction with hearing aids 4 years of age or less.
Figure 4:
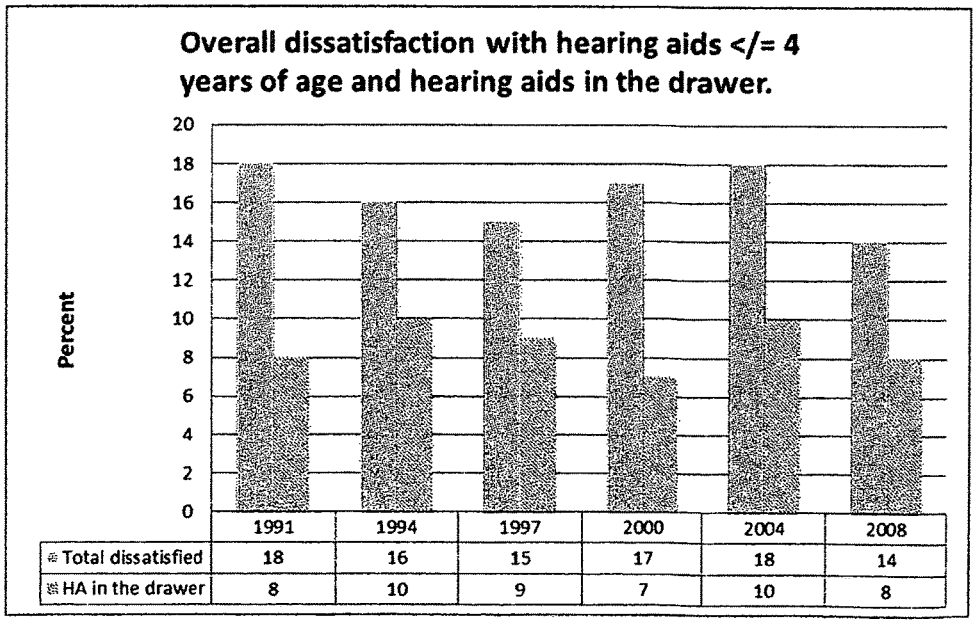
FIG. 4 shows a chart illustrating the overall dissatisfaction with hearing aids 4 years of age or less and hearing aids in the drawer.
Figure 5:
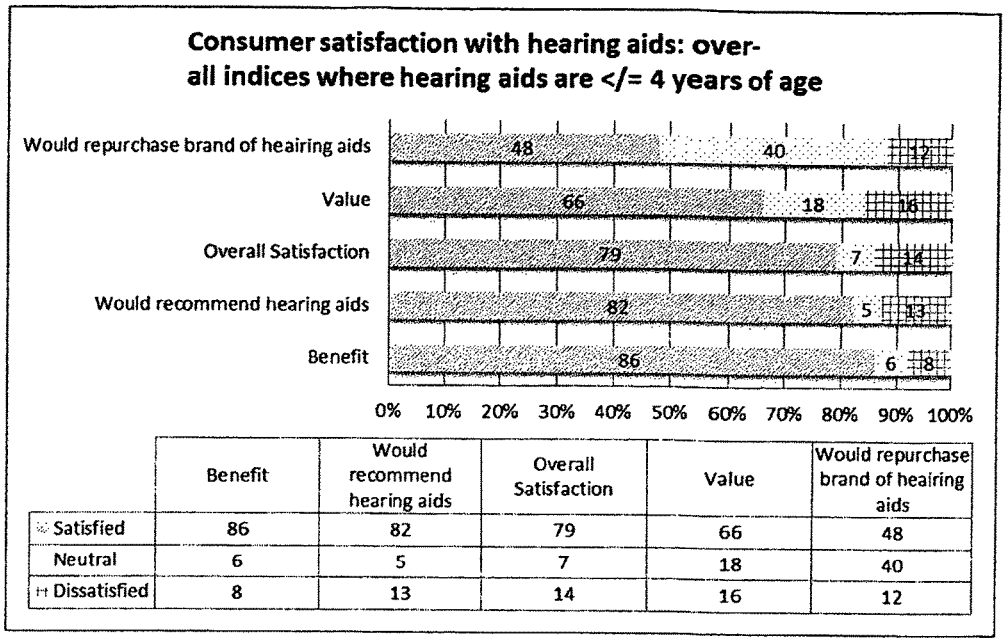
FIG. 5 shows a chart illustrating the consumer satisfaction with hearing aids with overall indices where hearing aids are 4 years of age or less.
Figure 6:
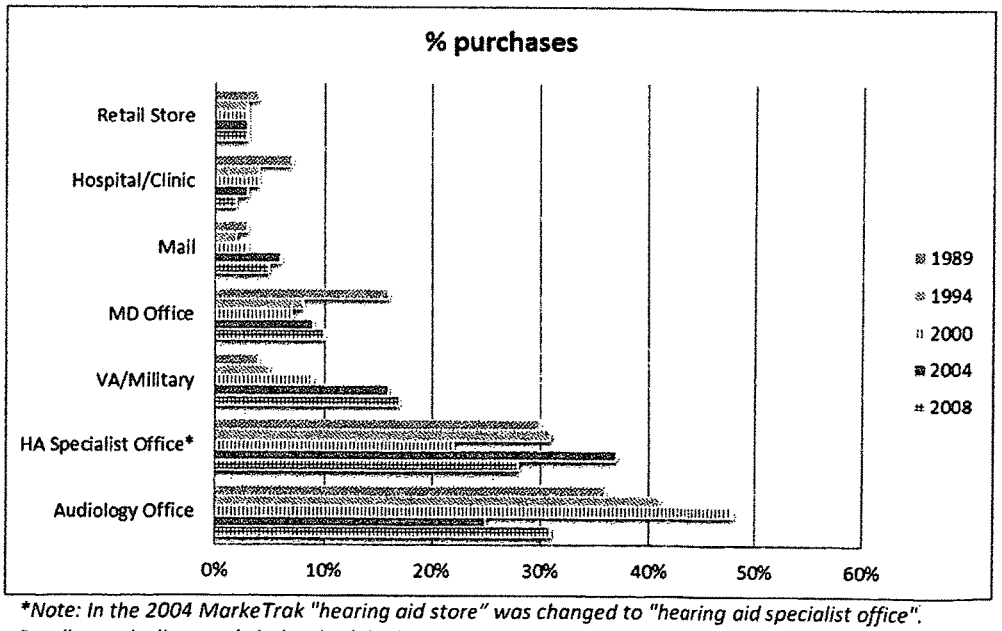
FIG. 6 shows a chart illustrating hearing aid purchases by store style.

FIG. 6 indicates that more than 50% of hearing aid purchases occur in audiology offices and hearing aid specialist offers, but surprisingly only less than 5% in (cheaper) retail stores, such as for example Costco etc.

Altogether, it has been observed in the field of hearing aids that in the past view years, thanks to the extensive use of digital technology, there have been considerable developments in simplifying the fitting part and speeding up the fine tuning. However, this has neither significantly influenced the way how the fine tuning process is executed nor the average number of store visits the customer has to accept. Apparently, the new technologies have mainly lead to an increase in prices.

Figure 7:
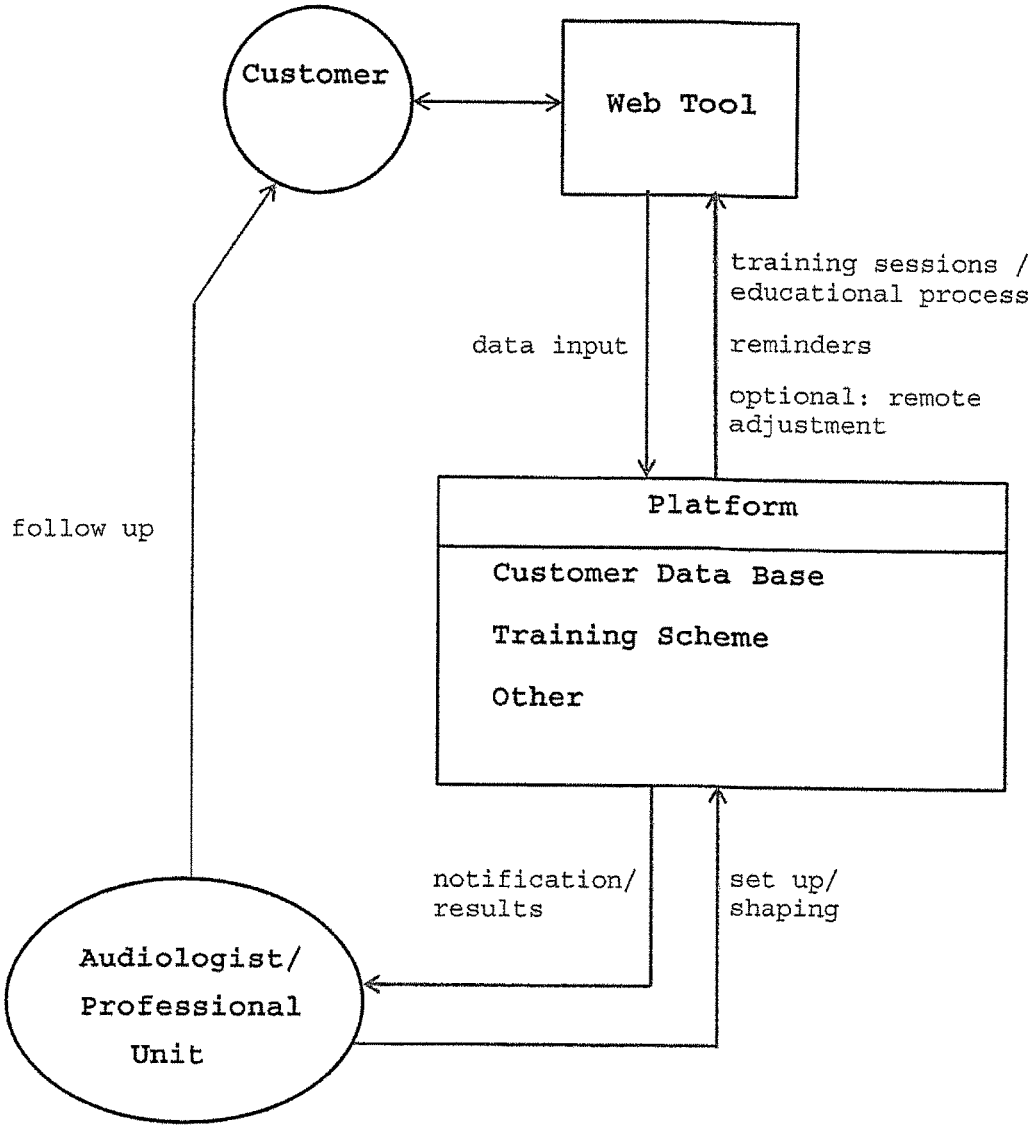
FIG. 7 shows the architecture of the inventive system.

Now, FIG. 7 shows the architecture of the inventive system used for optimizing the fine tuning of a generally known (respectively predictable) adaptation process on the basis of the individual needs of a customer, which is in the following explained together with the inventive process in an exemplary manner in context with a hearing aid fitting process.

The system comprises a platform, usually in form of a server with respective server software, on which at least a customer data base and a training scheme for the customer are provided. The platform may however also include other functions, as for example a remote access function in form of a programming function for a remote hearing aid adjustment/hearing aid fitting by a specialist (e.g. an audiologist).

Further, the system includes a web tool by means of which the customer can interact with the platform respectively the server or the server software.

A web tool in the context of the present application is a browser or an app that allows the user to access content and data customized for him and managed through a server/servers.

The web tool may be included in a personal computer, a laptop, a tablet computer or in a smart phone. In particular, the customer may therewith input his data into the customer database. Also, the hearing aid instruments may be attached to the web tool/a respective programming interface for remote adjustment purposes.

In addition, the system comprises an audiologist/professional unit which sets up the training content for the customer and which monitors the data input by the customer. The professional unit is also provided with means for establishing a personal contact with the customer. Usually, the professional unit is in the form of a call center (i.e. with employed audiologists) or an audiologist store or practice. The means for establishing a personal contact with the customer include for example telephone, email and chat facilities.

Figure 8:
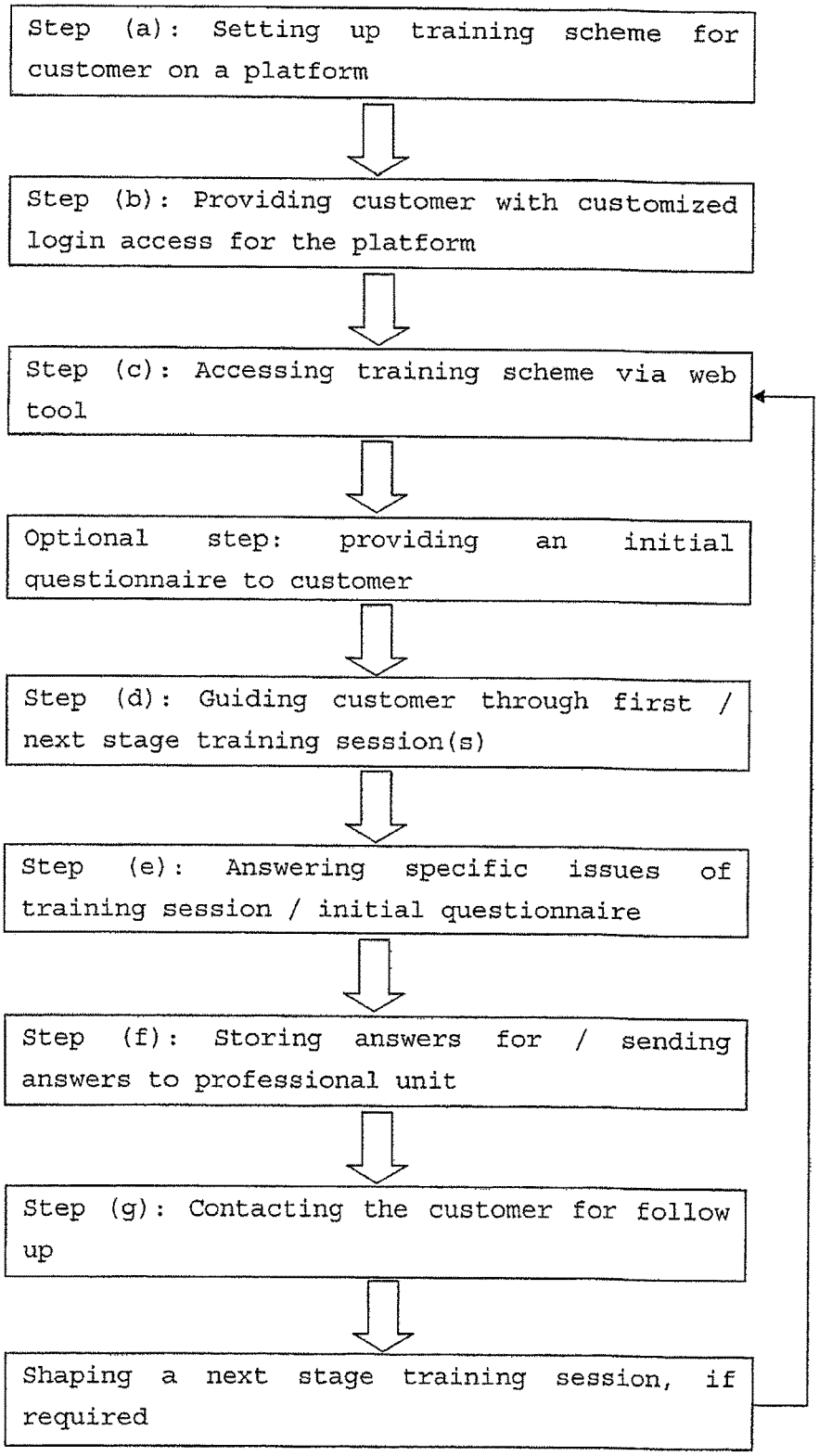
FIG. 8 shows a flow-chart of the basic steps of the inventive process.

The inventive fine tuning process, which is schematically depicted in FIG. 8, is preferably carried out on the inventive system and may include various steps.

Firstly, a training scheme for the customer is set up which is based on individual characteristics which are regularly determined in a preceding routine consultation with the customer—usually a normal hearing aid fitting—whereby characteristics of the hearing loss (e.g. conductive hearing loss, sensorineural hearing loss or mixed hearing loss), characteristics of the customer (e.g. ear anatomy, medical condition, lifestyle, etc.) and/or of the hearing aid used (e.g. ITE, ITC or BTE device) are considered. It is noted in this regard that during a normal hearing aid fitting, the audiologist checks the fit of the earmolds and trims the tubing to the correct length. The earhook on the hearing aid is attached to the tubing. For the custom shells of ITE's, the audiologist will e.g. also check the placement of the shell in the ear to see if the shell sits correctly and comfortably in the ear canal.

After setting up the customer-specific training scheme, the customer is equipped with a customized login access for the platform (e.g. a user name and a password).

The customer may then access the customized training content via a web tool included for example in a personal computer, a laptop, a tablet computer or a smart phone.

Subsequently, the customer (preferably after a short introductory portion where he is told how to take care of the instrument and what he can expect) is guided through a first stage training session dealing with specific issues of the training scheme set up for the customer on the basis of the above-described individual characteristics, i.e. hearing loss characteristics, personal/anatomic characteristics and hearing aid style. Among the specific issues of the first stage training session are for example product features as ease/battery change, fit/comfort, ease of insertion/removal form ear, visibility, ease/volume adjustment as well as features relating to sound quality/signal processing as clearness tone/sound, sound of voice, natural sounding, directionality, ability to hear soft sounds, whistling/feedback/buzzing, richness of sound/fidelity, comfort with loud sounds, chewing/swallowing sound, use in noisy situations and wind noise.

The specific issues of the first stage training session are answered by the customer by inputting the respective data via the web tool into the customer data base. Preferably, the customer gets a bonus (i.e. in form of discounts, extra consultation time etc.) after successfully answering the first stage training session.

The answers of the customer are stored for evaluation by the audiologist/professional unit in the customer database or sent for this purpose to the audiologist/professional unit. The audiologist/professional unit usually gets a notification from the system when the end user has completed a training session. It is noted that the audiologist/professional unit may also monitor the whole process on a cockpit screen and see how long and where the end user was visiting the platform respectively the web site. The audiologist/professional unit may enter his feedback and changes into a chart administered for each customer on the platform (cf. FIG. 9).

After evaluating the answers of the customer, the audiologist/professional unit will contact (or is informed that he shall contact) the customer personally for follow up on the initial questionnaire and/or the first stage specific topic via telephone, chat or email facilities. Of course, the customer may choose via a communication tool of the platform a desired contact time. It is also possible that the audiologist/professional unit remotely accesses the hearing aid instrument used by the customer, preferably via a programming interface or a manufacturer-specific device, in order to adjust the device, if needed.

Yet, it is noted that before the customer is guided through the first stage training session, he is preferably provided with an initial questionnaire which has to be answered by the customer before entering the first stage training session. The initial questionnaire includes general questions which relate to the customer's satisfaction with the routine consultation and/or the customer's general observations since then. It is noted that the specific issues of the first stage training session may also depend on the answers of the customer to the initial questionnaire.

After the personal follow up contact with the customer following the first stage training session, the audiologist/professional unit will, if required, shape the next stage training session for the customer with specific topics which may also depend on the previous answers of the customer and/or the follow up.

Thereafter, the customer is informed and, if applicable, reminded that a next stage training session is ready for the customer.

Then, the customer accesses again the custom-made training scheme via the web tool included in a personal computer, a laptop, a tablet computer or a smart phone.

Subsequently, the customer is guided through the next stage training session dealing with specific issues of the training scheme set up for the customer before. The specific issues of the next stage training session comprise for example product features as ease/battery change, fit/comfort, ease of insertion/removal form ear, reliability, visibility, length of trial period, frequency of cleaning, battery life, warranty, on-going expense, ease/volume adjustment as well as features relating to sound quality/signal processing as clearness tone/sound, sound of voice, natural sounding, directionality, ability to hear soft sounds, whistling/feedback/buzzing, richness of sound/fidelity, comfort with loud sounds, chewing/swallowing sound, use in noisy situations and wind noise. The variation and emphasis of the specific issues within the respective (i.e. second stage, third stage, fourth stage, etc.) training session depends at least partially on the answers of the customer in the prior training sessions and questionnaires as well as on the discretion of the audiologist respectively the professional unit.

The customer answers in each next step the specific issues of said next stage training session. Preferably, the customer gets again a bonus (i.e. in form of discounts, extra consultation time etc.) after successfully answering the respective next stage training session.

The answers of the customer are either stored in the customer data base or sent to the audiologist/professional unit for further evaluation. It is noted that the audiologist/professional unit may generally monitor the whole process on a cockpit screen. The audiologist/professional unit may enter his feedback and changes into a chart administered for each customer on the platform (cf. FIG. 9).

After evaluating the next stage answers of the customer, the audiologist/professional unit will contact (or is informed that he shall contact) the customer personally for follow up on the questionnaire and/or the next stage training session via telephone, chat or email facilities. Of course, the customer may choose via a communication tool of the platform a desired contact time. It is also possible that the audiologist/professional unit remotely accesses the hearing aid instrument used by the customer, preferably via a programming interface or a manufacturer-specific device, in order to adjust the device, if needed.

Yet, it is noted that before customer is guided through the respective next stage training session, he is preferably provided with a further initial questionnaire which has to be answered by the customer before entering said next stage training session. The initial questionnaire includes questions which relate to the customer's expectations and reality and may also influence the respective next stage training session.

The above described steps respectively sequence of steps is repeated in an analogue manner until the optimum fine tuning is achieved. The fine tuning process for a hearing aid will usually be completed after five to six repetitions, i.e. without going to the audiologist/store. The individual training stages are provided in intervals of 7 to 10 days such that the proposed process should be completed after approximately 60 days.

It is once again emphasized that it is the explicit aim of the above training sessions to provide for an educational process in which the inevitable (initial) gap between expectations and reality—which is particularly characteristic for the beginning of the use of hearing aids—is closed in a reliable and comfortable manner.

FIG. 9 provides an exemplary customized chart regarding a hearing aid fine tuning in accordance with the present invention. The chart includes a visit to a shop (e.g. audiologist store or practice) and six training sessions. The (exemplary) specific issues here are pain/comfort, volume, high/low, noise, feedback, understanding, telephone and wind which are evaluated on a scale from 0 (No) to 5 (Highest).

Thereby, the scale from 0 to 5 reflects the level of importance of a certain issue and also the amount of time/effort which may be scheduled for handling the issue during either the shop visit or during the respective interactive training session.

For example, the issue "Noise" is a very important issue for a user of a hearing aid and is thus assigned level 5. This level reflects that the highest preset time interval will be spent in the shop or later on during the individual training sessions with the discussion/treatment of this issue.

With regard to the individual training sessions, it may be the aim that each session is completed within about 15 to 20 minutes in order to avoid that the user gets bothered and/or does not (anymore) reconsider his answers properly. Thus, in session 1, for example, three pages with questions/instructions dealing with the issue "Noise" are provided which have to be answered/completed by the user. Thereby, for example, it may be envisaged that one page equals about 1 minute answering time. A level 4 session may thus include two pages, a level 3 session 1 page and a level 2 session 0.5 pages.

In this way, the level of importance may be reduced in the course of the process as the problems of the user decrease until level 1 (Name-it) is reached, where a confirmation is rendered by the user that e.g. the hearing aid instrument now fulfils his expectations with regard to the issue "Noise". For e.g. the issue "Pain/Comfort", level 0 is chosen by the user when he does not feel any more pain or discomfort with the instrument.

Of course, it is also possible that for a specific issue, the problems increase for the user during the course of the process such that e.g. after a level 3 session the next session has to be a level 4 session—with more pages to answer/more time to be spent on the respective questions/instructions (cf. also the issue "Wind" in the chart which does naturally not play a role in the shop but regularly becomes relevant after the first training session, i.e. when the user has gathered some experience with the device outside of closed rooms).

In this way, a unique journey is created for each end user with the aim that after session 6 the expectations of the end user are fully met.

Those skilled in the art will appreciate that the above time settings, page numbers etc. are merely mentioned in an exemplary manner and may thus also differ depending on the specific user and/or the specific field of application.

What is claimed is:

1. A method for optimizing fine tuning of a hearing aid fitting process based on individual needs of a customer, the method comprising:

(a) setting up on a computer platform a hearing aid training scheme for a customer based on at least one of an is questionnaire from the customer and individual characteristics determined during a preceding fitting of the hearing aid and/or a preceding routine consultation with on the customer;

(b) providing the customer with a customized login access for the platform;

(c) accessing the set up training scheme by the customer via a web tool;

(d) guiding by the platform the customer through a first stage training session dealing with specific issues of the training scheme set up for the customer in step (a);

(e) answering the first stage specific issues by the customer;

(f) the platform selectively storing the answers of the customer in the platform or sending the answers to a professional unit;

(g) after evaluation of the answer by the professional unit, contacting the customer by professional unit for a personal follow up the initial questionnaire and/or the first stage specific issues by the professional unit; and (h) creating in the platform a next stage training session by the professional unit for the customer with specific issues based on the answers of the customer and the follow up of step (g).

2. The method according to claim 1, wherein step (h) is followed by the steps:

(i) informing and, if applicable, reminding the customer that the next stage training session is ready;)

(j)accessing the set up training scheme by the customer via the web tool;

(k) guiding the customer through the next stage training session dealing with the specific issues of the next stage training session set up for the customer in step (h);

(l)answering the next stage specific issues by the customer;

(m) storing the next stage answers of the customer for or sending the next stage answers of the customer to the professional unit; and (n) contacting the customer for follow up on the initial questionnaire and/or the next stage specific issues by the professional unit.

3. The method according to claim 2, wherein steps (i) to (n) are repeated in an analogue manner until the fine tuning is completed.

4. The method according to claim 2, wherein after step (j) the initial questionnaire is provided to the customer and has to be answered by the customer in a next step.

5. The method according to claim 4, wherein the initial questionnaire includes general questions regarding the customer's expectations and reality.

6. The method according to claim 2, wherein the specific issues of step (k) may at least partially depend on the answers of the customer.

7. The method according to claim 2, wherein after step (m) the customer is informed that the professional unit will get in contact with him.

8. The method according to claim 2, wherein after step (m) the professional unit is informed that it shall get in contact with the customer.

9. The method according to claim 8, wherein the customer may choose a desired contact time.

10. The method according to claim 2, wherein the customer gets a bonus after step (l).

11. The method according to claim 2, wherein after step (m) the professional unit enters his feedback and changes into a chart administered for each customer on the platform.

12. The method according to claim 2, wherein after step (m) the professional unit remotely accesses an instrument used by the customer.

13. The method according to claim 2, wherein during the next stage training session the following specific issues are evaluated: ease of battery change, fit and comfort, ease of insertion and removal from ear, reliability, visibility, length of trial period, frequency of cleaning, battery life, warranty, on-going expense, ease of volume adjustment, clearness of tone and sound, sound of voice, natural sounding, directionality, ability to hear soft sounds, whistling and feedback and buzzing, richness of sound and fidelity, comfort with loud sounds, chewing and swallowing sound, use in noisy situations and/or wind noise.

14. The method according to claim 2, wherein the first and next stage training sessions take place in intervals ranging from 2 to 14 days.

15. The method according to claim 1, wherein the individual characteristics of step (a) are determined in the preceding routine consultation with the customer.

16. The method according to claim 1, wherein after step (c) the initial questionnaire is provided to the customer and has to be answered by the customer in a next step.

17. The method according to claim 16, wherein the initial questionnaire includes general questions that relate to the routine consultation with the customer of step (a) and/or the customer's general observations since then.

18. The method according to claim 16, wherein the specific issues of step (d) may also depend on the answers of the customer in the initial questionnaire.

19. The method according to claim 1, wherein the platform comprises at least a server and respective server software.

20. The method according to claim 1, wherein after step (f) the customer is informed that the professional unit will get in contact with him.

21. The method according to claim 1, wherein after step (f) the professional unit is informed that it shall get in contact with the customer.

22. The method according to claim 21, wherein the customer may choose a desired contact time.

23. The method according to claim 1, wherein the customer gets a bonus after step (e).

24. The method according to claim 1, wherein after step (f) the professional unit enters his feedback and changes into a chart administered for each customer on the platform.

25. The method according to claim 1, wherein after step (f) the professional unit remotely accesses an instrument used by the customer.

26. The method according to claim 1, wherein for setting up the training scheme, characteristics of hearing loss, characteristics of the customer, and/or characteristics of the hearing aid used are considered.

27. The method according to claim 1, wherein during the first stage training session the following specific issues are evaluated: ease of battery change, fit and comfort, ease of insertion and removal from ear, visibility, ease of volume adjustment, clearness of tone and sound, sound of voice, natural sounding, directionality, ability to hear soft sounds, whistling and feedback and buzzing, richness of sound and fidelity, comfort with loud sounds, chewing and swallowing sound, use in noisy situations and/or wind noise.

28. The method according to claim 1, wherein the individual characteristics of step (a) are determined in the preceding fitting of the hearing aid.

29. The method according to claim 1, wherein the professional unit is an employee of a call center, an audiologist store, or an audiologist practice.

* * * * *